US007501992B2

(12) United States Patent
Yamagajo et al.

(10) Patent No.: US 7,501,992 B2
(45) Date of Patent: Mar. 10, 2009

(54) PLANAR ANTENNA

(75) Inventors: Takashi Yamagajo, Kawasaki (JP); Toru Maniwa, Kawasaki (JP); Andrey Andrenko, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/819,626

(22) Filed: Jun. 28, 2007

(65) Prior Publication Data

US 2008/0158086 A1 Jul. 3, 2008

(30) Foreign Application Priority Data

Jul. 28, 2006 (JP) ..... 2006-206437

(51) Int. Cl.
*H01Q 19/10* (2006.01)
*H01Q 9/28* (2006.01)

(52) U.S. Cl. ..... 343/818; 343/795

(58) Field of Classification Search ..... 343/793, 343/795, 818, 895

See application file for complete search history.

(56) References Cited

U.S. PATENT DOCUMENTS

| | | | | |
|---|---|---|---|---|
| 6,057,803 | A | 5/2000 | Kane et al. | |
| 6,407,717 | B2 * | 6/2002 | Killen et al. | 343/815 |
| 6,417,816 | B2 * | 7/2002 | Sadler et al. | 343/795 |
| 6,864,852 | B2 * | 3/2005 | Chiang et al. | 343/817 |
| 7,315,289 | B2 * | 1/2008 | Puente Baliarda et al. | 343/817 |

FOREIGN PATENT DOCUMENTS

| | | |
|---|---|---|
| JP | 9-260925 | 10/1997 |
| JP | 2002-76765 A | 3/2002 |
| JP | 2005-072716 | 3/2005 |
| JP | 2005-102183 | 4/2005 |

OTHER PUBLICATIONS

Koichi Sakaguchi, Tohru Hamaki, Nozomu Hasebe; *A Circularly Polarized Omnidirectional Antenna*; Nov. 1996; pp. 1704-1710; XP000692334.

Extended European Search Report; Application No. 07111229.6-1248; Reference No. P108787EP00/CLH; Search Report date Aug. 29, 2007.

* cited by examiner

*Primary Examiner*—Shih-Chao Chen
(74) *Attorney, Agent, or Firm*—Hanify & King, P.C.

(57) ABSTRACT

The planer antenna includes: a linear radiating antenna element to which electric power is to be supplied; and multiple linear parasitic antenna elements to which electric power is not to be supplied. The parasitic antenna elements are disposed at a position at which the radiating antenna element and the parasitic antenna elements cross each other without contact. The parasitic antenna elements lying in a direction in which the radiating antenna element and the parasitic antenna elements cross each other, and each of the crossing portions of said plural parasitic antenna elements, which portions cross said radiating antenna element, are bent in such a manner that the crossing portions of the parasitic antenna elements are in parallel with the radiating antenna element. Thus, it is possible to provide a planer antenna which can obtain a good circularly polarized wave with a simple construction. In addition, the planar antenna can be downsized.

10 Claims, 10 Drawing Sheets

CONBINATION OF 3 DIPOLES OF WHOLE LENGTHS ABOUT 0.5 λ

PLANAR ANTENNA

CROSS REFERENCE TO RELATED APPLICATION(S)

This application is based on and hereby claims priority to Japanese Application No. 2006-206437 filed on filed on Jul. 28, 2006 in Japan, the contents of which are hereby incorporated by reference.

BACKGROUND OF THE INVENTION (1) Field of the Invention

The present invention relates to a planar antenna. The invention relates particularly to an art suitable for use as an antenna which is formed on a dielectric substrate to generate circularly polarized waves.

(2) Description of the Related Art

Recently, vehicles (movable objects) such as automobiles are often equipped with antennas for high-frequency band GPS (Global Positioning System) and antennas for receiving satellite radio waves of satellite digital broadcasting. In addition, there is a need for antennas for transceiving radio waves in ETC (Electronic Toll Collection) system, which automatically collects tolls for express ways and toll roads, and radio beacons in VICS (Vehicle Information Communications System), which provides traffic information.

Of such radio waves to be transceived by movable objects, circularly polarized waves are used in GPS radio waves, satellite radio waves for satellite broadcasting, and ETC radio waves. Most of the previous antennas for circularly polarized waves are patch antennas (planar antenna).

FIG. 10 is a schematic plan view showing a construction of an example of a previous planar antenna, and it is disclosed in the following patent document 1. The planar antenna of FIG. 10, which is for receiving right-hand circularly polarized waves, includes a square-like loop antenna [radiating (power supplied) element] 120 and a linear electric conductor [parasitic (non-power-supplied) element] 140 mounted on a dielectric (transparent film) not illustrated. The linear electric conductor 140, which is an independent conductor not coupled to the loop antenna 120, is bent to be divided into two parts, a first part 140A and a second part 140B. Reference characters 160 and 170 designate power-feeding terminals for supplying the loop antenna 120 with electric power; reference character 270 designates connecting conductors which connect power-feeding terminals 160 and 170 to the loop antenna 120; reference character CP designates the center point of the loop antenna 120.

As shown in FIG. 10, the parasitic element 140 is placed outside the loop antenna 120 and is arranged close to the loop antenna 120. In more detail, the first part 140A is placed in parallel with one side of the loop antenna 120; the second part 140B is placed in parallel with a straight line which connects an intermediate point between the power-feeding terminals 160 and 170 and an apex of the loop antenna 120 which is opposite the intermediate point.

Referring to paragraph [0069] of the following patent document 1, a description will be made hereinbelow of the parasitic element 140. A loop antenna 120 without a parasitic element 140, in particular, a loop antenna 120 whose circumference (the total length of the antenna conductor) is equal to one wavelength, can receive only an electric field component (lateral component) in the vertical direction (that is, it is impossible to completely receive circularly polarized waves in which the direction of the electric field changes over time). The parasitic element 140 arranged close to the loop antenna 120 makes it possible for the loop antenna 120 to receive a vertical component of the circularly polarized waves.

That is, the second part 140B of the parasitic element 140 takes in the vertical component of the circularly polarized waves, and this received vertical component is coupled to the antenna conductor of the loop antenna 120 by the first part 140A which is close to the antenna conductor of the loop antenna 120. As a result, the vertical and lateral components of the circularly polarized waves are received by the loop antenna 120 in phase. In other words, with only the second part 140B, it is difficult to transfer the received circularly polarized waves to the loop antenna 120. Thus, in order to efficiently transfer the received circularly polarized waves to the loop antenna 120, the parasitic element 140 is provided with the first part 140A.

Further, other previous antenna construction are disclosed in the following patent documents 2 and 3.

Patent document 2 relates to a thin and flat antenna construction including more than one stacked loop antenna element. The antenna of patent document 2 is capable of generating left-hand circularly polarized waves and right-hand circularly polarized waves at the same time from two directions.

Patent document 3 relates to an antenna construction in which a large square row antenna is provided in the plane of an antenna. Inside the large antenna, a small dipole antenna, a loop antenna, and a planar antenna are arranged so that the directivities of the antennas formed by interference of the antennas are optimum.

[Patent document 1] Japanese Patent Application Laid-open No. 2005-102183

[Patent document 2] Japanese Patent Application Laid-open No. 2005-72716

[Patent document 3] Japanese Patent Application Laid-open No. HEI 9-260925

However, the art disclosed in patent document 1 is disadvantageous in that electric field distribution to the parasitic element 140 is weak due to the antenna construction, so that it is difficult to obtain a sufficiently good circular polarization characteristic. This is probably because a linear antenna (e.g., a dipole antenna) simply mounted on a dielectric substrate generates a beam in the direction along the surface of the dielectric substrate, so that the intensity of radiation in the direction (that is, the direction along the thickness) crossing the surface of the dielectric substrate is weak.

Here, the purpose of the art of patent document 2 is generating left-hand and right-hand circularly polarized waves at the same time. In patent document 3, it is possible to place multiple antennas closely or concentratedly in a narrow area, and thus down-sizing is available, and the purpose of the invention is to prevent noise from inside automobiles. Therefore, neither of the applications aims at obtaining a good circular polarization characteristic.

SUMMARY OF THE INVENTION

With the foregoing problems in view, it is an object of the present invention to provide a planar antenna with simple configuration which realizes a good circular polarization characteristic. In addition, it is also an object of the present invention to downsize the planar antenna. Here, the application of the present invention should by no means be limited to movable objects such as automobiles, and the present invention is applicable also to RFID (Radio Frequency IDentification) systems, POS systems, security systems for protecting products from theft, and other radio communication systems.

In order to accomplish the above object, according to the present invention, the following planar antenna is used.

(1) As a generic feature, there is provided a planer antenna, comprising: a linear radiating antenna element to which electric power is to be supplied; and a plurality of linear parasitic antenna elements to which electric power is not to be supplied, wherein the parasitic antenna elements are disposed at a position at which the radiating antenna element and the parasitic antenna elements cross each other without direct contact, the parasitic antenna elements lying in a direction in which the radiating antenna element and the parasitic antenna elements cross each other, and wherein each of the crossing portions of the plural parasitic antenna elements, which portions cross the radiating antenna element, are bent in such a manner that the crossing portions of the parasitic antenna elements are parallel with the radiating antenna element.

(2) As a preferred feature, the radiating antenna element is formed on one side of a dielectric substrate, and the plural parasitic antenna elements are formed on the other side of the dielectric substrate.

(3) As another preferred feature, each of the plural parasitic antenna elements are disposed so as to be orthogonal to the radiating antenna element.

(4) As yet another preferred feature, two of the plurality of parasitic antenna elements are disposed at symmetrical positions with respect to a feeding point of the radiating antenna elements.

(5) As a further preferred feature, the radiating antenna elements and the plural parasitic antenna elements are dipole antenna elements.

(6) As a still further preferred feature, the lengths of the radiating antenna element and of the plural parasitic antenna elements are equal or approximate to half-wave lengths to be transceived by the radiating antenna element and the plural parasitic antenna elements, respectively.

(7) As a yet further preferred feature, at least a portion of the parasitic antenna elements, excluding the crossing portion, is formed as a meandar line.

According to the present invention, at least any of the following effects and benefits is obtained.

(1) Partly since the parasitic antenna elements are disposed and lying the direction in such a manner that the parasitic antenna elements crosses (preferably orthogonally or approximately orthogonally) the radiating antenna element without contact, and partly since the crossing portion therebetween is bent in such a manner that the crossing portion is in parallel with the radiating antenna, it is possible for the radiating antenna and the parasitic antenna to generate polarized wave components whose polarized wave surfaces cross each other.

Accordingly, it is possible to realize a planar antenna which can generate a good circularly polarized wave with a small size (area) (for example, the size of the degree of the half-wave length of the to-be-transceived wave length×the half-wave length).

(2) Further, a part of the parasitic antenna, excluding the above-mentioned crossing portion, having the shape of a meanda line will down-size the planar antenna.

The above and other objects and features of the present invention will be understood by reading carefully the following description with accompanying drawings. Preferred embodiments of the present invention will be described in more detail referring to the accompanying drawings. The drawings are illustrative and are not to be limitative of the scope of the present invention.

DESCRIPTION OF THE PREFERRED EMBODIMENT(S)

Preferred embodiments of the present invention are described in more detail below referring to the accompanying drawings.

Here, the present invention should by no means be limited to the illustrated embodiment below, and various changes or modifications may be suggested without departing from the gist of the invention.

[A] One Preferred Embodiment

Figure 1:
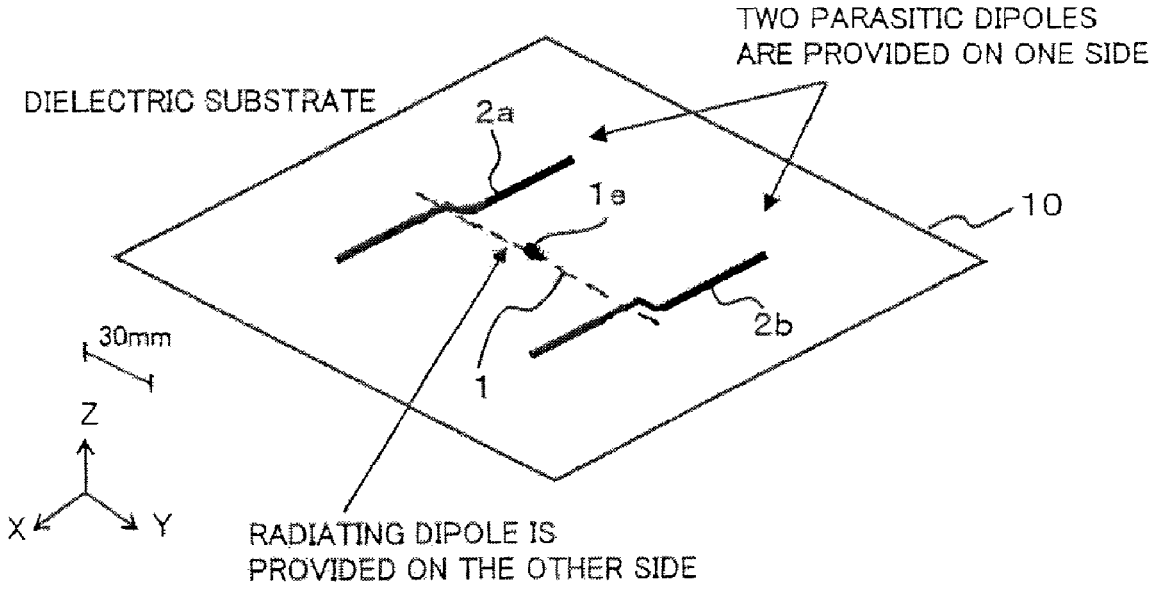
FIG. 1 is a schematic perspective view of a planar antenna according to one preferred embodiment of the present invention.

FIG. 1 is a schematic perspective view illustrating the construction of a planar antenna according to one preferred embodiment of the present invention.

The planar antenna of FIG. 1 has a dipole antenna element (linear radiating antenna element) 1 which is a linear conductor provided on one side (rear side in FIG. 1) of a dielectric substrate (hereinafter will be also simply called the "dielectric" or the "substrate") 10 made of glass or ceramic, etc. The dipole antenna element 1 is supplied with electric power from a feeding point le. In addition, on the other side of the substrate 10 (front surface in FIG. 1), multiple (two) linear conductors (linear parasitic conductor) 2*a* and 2*b* (hereinafter will be also called the "parasitic antennas 2*a*, 2*b*, or the antennas 2*a*, 2*b*), to which electric power is not to be supplied, are provided in parallel or approximately in parallel with a predetermined interval therebetween. That is, when the substrate 10 is transparent, the antennas 1, 2*a*, and 2*b* are arranged so that they form the shape of letter "H".

More specifically, assuming that the wavelength to be transceived is λ, on one side (XY plane) of the substrate 10, a radiating antenna 1 of a total length of 0.5λ is formed in the direction in parallel with the Y axis. On the other side (XY plane) of the substrate 10, parasitic antennas 2*a* and 2*b*, each having a total length of 0.5λ, are formed in the vicinity of the opposite ends of the radiating antenna 1 (that is, at a position crossing the radiating antenna 1) in the direction crossing the radiating antenna 1, preferably in the orthogonal or approximately orthogonal direction (in the direction parallel with the X axis).

Figure 2:
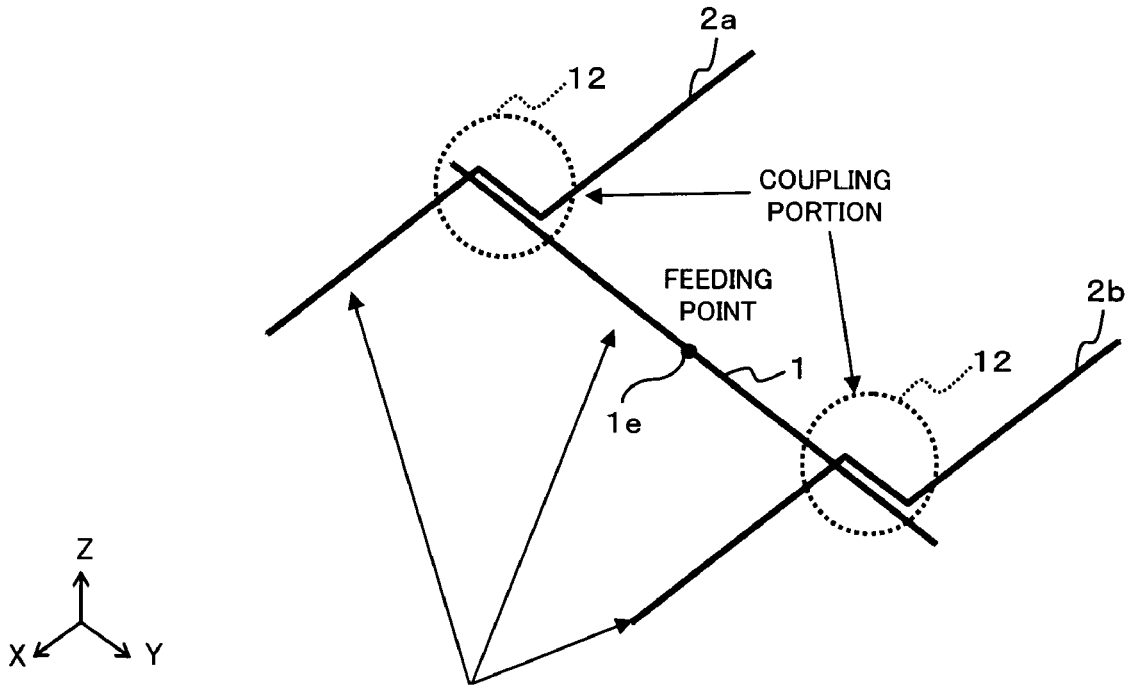
FIG. 2 is a schematic perspective view in which antenna elements of the planar antenna of FIG. 1 is enlarged.

Further, as illustrated in an enlarged manner in FIG. 2, a part of each of the parasitic antennas 2*a* and 2*b* (for example, the center part), more specifically, a part crossing (preferably orthogonal to) the radiating antenna 1, viewing from the Z axis, is bent so as to be parallel with the radiating antenna 1. This parallel part functions as a connection part 12 for effectively performing electromagnetic connection with the radiating antenna 1 effectively.

In this instance, the radiating antenna 1 is apart from the radiating antennas 2*a*, 2*b* by the thickness of the substrate 10. In FIG. 2, such a situation is illustrated in the above-mentioned connection part 12. That is, the radiating antenna land the parasitic antennas 2*a*, 2*b* are insulated by means of the dielectric material. Here, viewing from the Z axis, the radiating antenna 1 and the parasitic antennas 2*a* and 2*b* seem to be overlapped (identical) in the connection part 12.

In this manner, the planar antenna of the present embodiment can be realized as a 0.5λ×0.5λ size (area).

Figure 3:
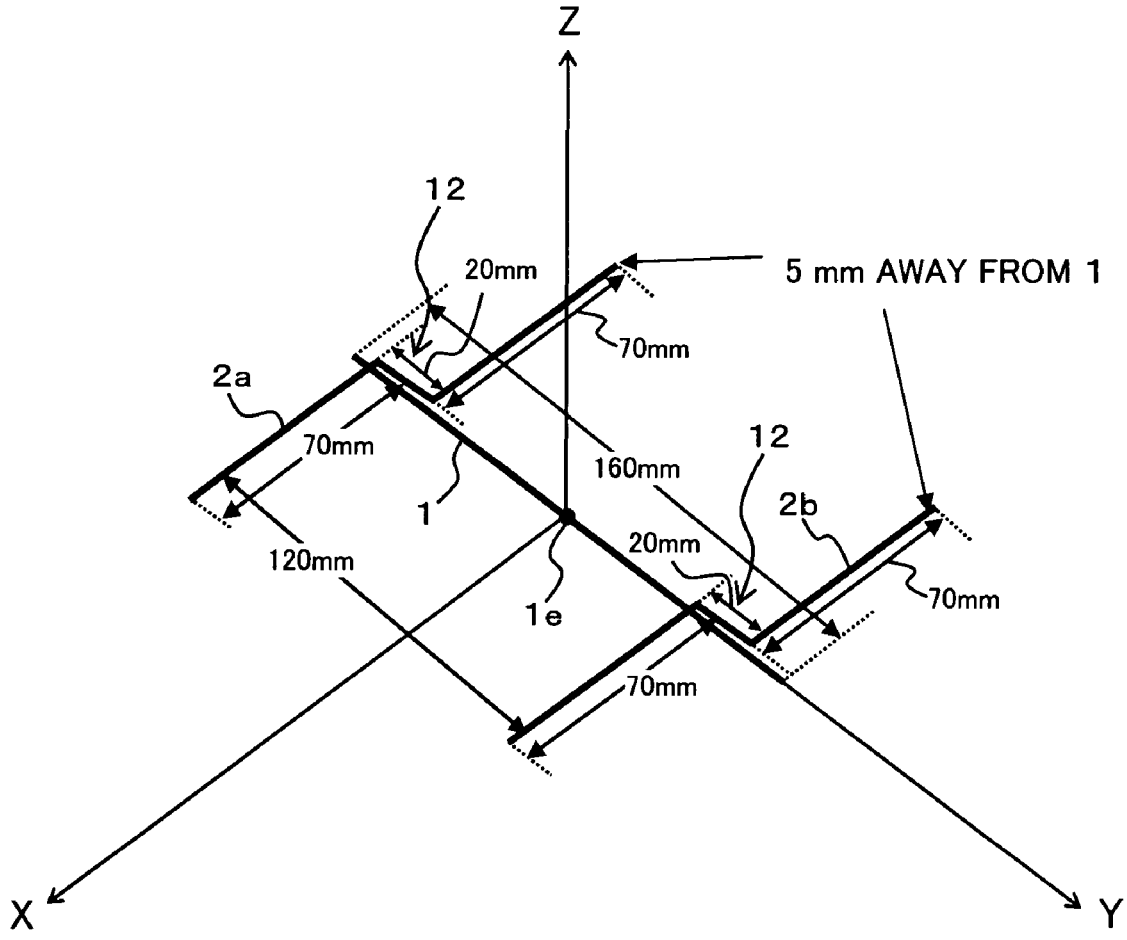
FIG. 3 a schematic perspective view of the planar antenna of FIG. 1 and FIG. 2 with the sizes of the antenna elements.

FIG. 3 shows an example of the sizes of various parts. In the example of FIG. 3, the frequency of electric wave coped with (transceived) is 950 MHz (that is, λ≈320 mm). The length of each of the antennas 1, 2*a*, and 2*b* is 0.5λ=160 mm. Each of parasitic antennas 2*a* and 2*b* are positioned ±60 mm away from the radiating antenna 1 (that is, the interval in the Y-axis direction between the parasitic antennas 2*a* and 2*b* is 120 mm). The connection part 12 (Y-axis direction) between the parasitic antennas 2*a* and 2*b* and the radiating antenna 1 is 20 mm, and the remaining part of the parasitic antennas 2*a* and 2*b* is 70 mm in the X-axis direction. Further, the XY plane on which the radiating antenna 1 is formed is apart from the XY plane on which the parasitic antennas 2*a* and 2*b* by is defined 5 mm in the Z-axis direction (this corresponds to that the thickness of the substrate 10 is 5 mm).

In this instance, the distance (interval) between the parasitic antennas 2*a* and 2*b* in the Y-axis direction is preferably set to an interval which provides a good connection efficacy between the radiating antenna 1 and the connection part 12 based on the electric field intensity distribution when electricity is supplied to the radiating antenna 1. Preferably, the connection part 12 may be located at a portion where strength of the electric field intensity is stronger than other portions when electricity is supplied to the radiating antenna 1. That is, in the electric field intensity along the radiating antenna 1, the electric field intensity (absolute value) tends to increase from the center point (in the vicinity of the feeding point le) to the end point (in the ±Y-axis direction) (takes the maximum value at the end point). Thus, since the combination efficacy is good, the above-mentioned connection parts 12 of each of the parasitic antennas 2*a* and 2*b* are preferably positioned in the vicinity of the end points of the radiating antenna 1.

Further, each of the antennas (conductor patterns) 1, 2*a*, 2*b* can be easily formed by means of a printing technology such as silver printing. Using dual-sided printing at the same time, manufacturing steps can be reduced, thereby reducing manufacturing cost (hereinafter, the same goes for).

In this type of antenna construction, if electricity is supplied from the feeding point 1*e* to the radiating antenna 1, an electric field is radiated in the ±Z-axis direction so that the radiating antenna 1 has a cross polarization component, and each of the parasitic antennas 2*a* and 2*b* has the other polarization component whose phase is later than the above polarization component by 90° and whose polarization is different by 90°.

More precisely, an electric field (Ey field) having a polarization (horizontal polarization) component in the Y-axis direction is generated by means of the radiating antenna 1, and this combines with the parasitic antennas 2*a* and 2*b* at the connection portion 12. As a result, an electric current is made to flow in each of the parasitic antennas 2*a* and 2*b*. Here, since the parasitic antennas 2*a* and 2*b* extend in the ±X-axis direction from the connection portion 12, an electric field (Ex field) having a polarization (vertical polarization) in the X-axis direction is generated.

As a result, in the Z-axis direction, an electric field, that is, a circularly polarized [in this case, Right-Hand Circularly Polarized (RHCP)] field, is generated by means of combining the above-mentioned Ey field and Ex field. In other words, to generate a polarized wave (vertically polarized wave) crossing a polarized wave (horizontally polarized wave) generated by the radiating antenna 1, which is a linear antenna element, by mean of the parasitic antennas 2*a*, 2*b*, the above-mentioned planar antenna forms a linear part extending in the direction crossing the radiating antenna 1, being insulated from the radiating antenna 1 by the substrate 10 (dielectric material).

Here, by means of adjusting the shape of the parasitic antennas 2*a*, 2*b* [the shape of the connection portion 12 connecting with the radiating antenna 1 (the length of the parallel portion)], the distance between the parasitic antennas 2*a* and 2*b* in the Z-axis direction (the thickness of the substrate 10), the position in the Y-axis direction, it is possible to adjust the intensity and the phase of crossing electric field components which are crossing orthogonally, thereby making it possible to realize an ideal circularly polarized wave.

Figure 4:
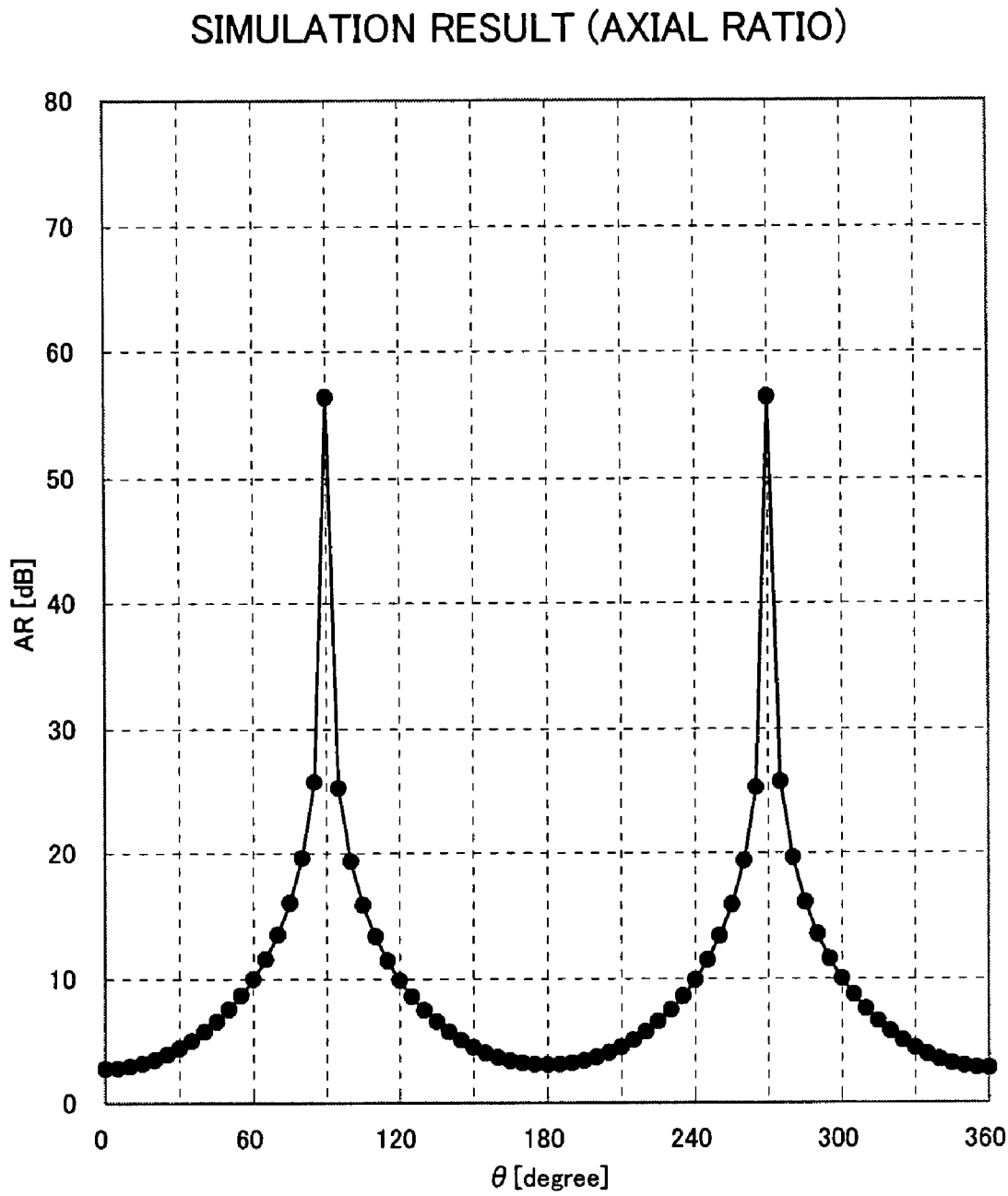
FIG. 4 is a diagram showing an example of a simulation result of a planar antenna on the assumption of the size shown in FIG. 3.

FIG. 4 shows a simulation result [an Axial Ratio (AR)] in a case where a radio signal of 950 MHz is supplied to the radiating antenna 1, on the assumption that the size described in FIG. 3 is given and that each of the antenna 1, 2*a*, and 2*b* are complete electric conductor, and that the substrate 10 does not exist [that is, the space between the XY place on which is formed the radiating antenna 1 and the XY place on which the parasitic antennas 2*a*, 2*b* are formed is filled with air (an dielectric constant $\in_r=1$).

As shown in FIG. 4, assuming that an angle formed between an electric wave (beam) and +Z-axis is θ, the axial ratio takes a minimum value (the order of 3 dB) when θ=0 (360), 180 [deg]. In this case, it is clear that a good circularly polarized wave in the front-back side direction (the ±Z-axis direction) of the planar antenna is obtained.

In this manner, according to the planar antenna of the present embodiment, by means of arranging the radiating antenna 1, which is one radiating element, and the dipole antenna elements 2*a* and 2*b*, which are multiple (two) parasitic elements, in combination as shown in FIG. 1 through FIG. 3, the polarization surface of the radiating antenna 1 and the parasitic elements 2*a* and 2*b* cross orthogonally, and it is possible to generate polarization components different in phase by 90°.

Accordingly, it is possible to realize a planar antenna which can generate good polarized waves in the surface and the back surface direction with a down-sized area of the degree of 0.5 λ×0.5 λ. Thus, down sizing of the planar antenna is possible. As a result, when the present planar antenna is used as a Reader/Writer (RW) antenna for RFID tags, it becomes possible to recognize RFID tags existing in a large area.

[B] MODIFIED EXAMPLE

Figure 5:
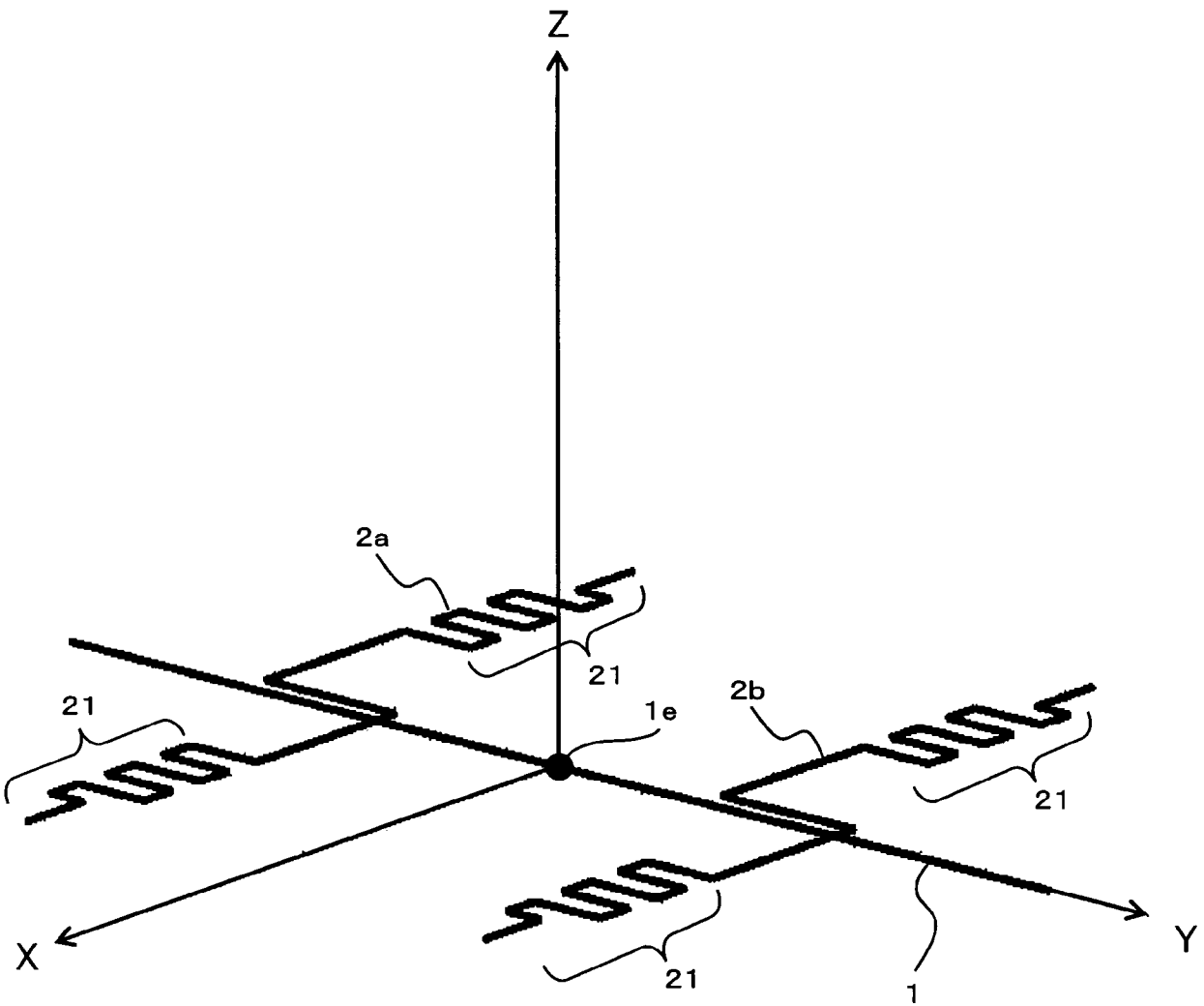
FIG. 5 is a schematic perspective view showing a modified example of the planar antenna of FIG. 1.

FIG. 5 is a schematic perspective view of a modified example of the planar antenna of FIG. 5. In comparison with the planar antenna illustrated in FIG. 1 through FIG. 3, in the planar antenna of FIG. 5, portions the above-described parasitic antennas 2*a*, 2*b* is bent in a meanda-like manner (see reference character 21). In addition, the surface (XY plane) on which these parasitic antennas 2*a* and 2*b* are formed is apart (insulated) from the surface (XY plane) on which the radiating antenna 1 is formed, by the degree of 1.5 mm in the Z-axis direction (the thickness of the above-described substrate 10 is 1.5 mm).

Figure 6:
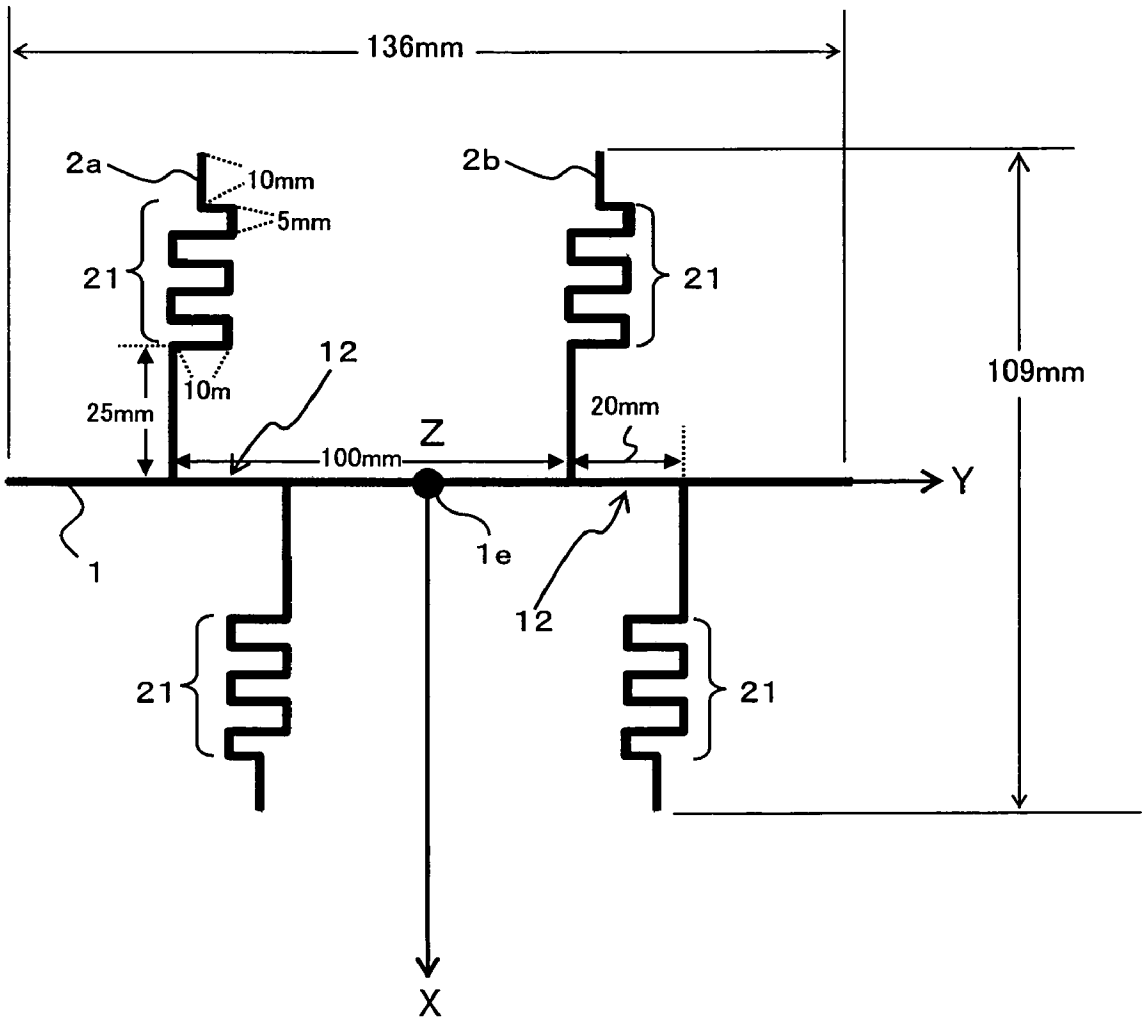
FIG. 6 is a plane view showing the planar antenna of FIG. 5 with the sizes of antenna elements.

More specifically, as shown in the schematic plan view of FIG. 6, the length (in the Y-axis direction) of the radiating antenna 1 is 136 mm (in the vicinity of 0.5λ), and the length (in the X-axis direction) of the parasitic antennas 2*a* and 2*b* is 109 mm. The length between the parasitic antennas 2*a* and 2*b* is 100 mm, and the length of the connection portion 12 between the radiating antenna 1 and the parasitic antennas 2*a* and 2*b* is 20 mm. The length (in the X-axis direction) between the end of the connection portion 12 and the meanda lines 21 of the parasitic antennas 2*a* and 2*b* is 25 mm. The length of the meanda lines 21 in the Y-direction is 10 mm, and their length in the X-axis direction (pitch) is 5 mm. The length between the ends of the parasitic antennas 2*a* and 2*b* and the meandar line is 10 mm. Of course, these sizes indicate only example values and they can be varied as appropriate.

In this instance, in the present example, each of the antennas (conductor patterns) 1, 2*a*, and 2*b* can be easily formed by using a printing technique such as silver printing. Using dual-sided printing at the same time, manufacturing steps can be reduced, thereby reducing manufacturing cost (hereinafter, the same goes for).

In this type of antenna construction, also, if electricity is supplied from the feeding point 1*e* to the radiating antenna 1, an electric field is radiated in the ±Z-axis direction so that the radiating antenna 1 has a cross polarization component, and each of the parasitic antenna 2*a* and 2*b* has the other polarization component whose phase is later than the above polarization component by 90° and whose polarization is different by 90°.

That is, an electric field (Ey field) having a polarization (horizontal polarization) component in the Y-axis direction is generated by means of the radiating antenna 1, and this combines with the parasitic antennas 2*a* and 2*b* at the connection portion 12. As a result, an electric current is made to flow in each of the parasitic antennas 2*a* and 2*b*. Here, since the parasitic antennas 2*a* and 2*b* extend in the ±X-axis direction from the connection portion 12, an electric field (Ex field) having a polarization (vertical polarization) in the X-axis direction is generated.

As a result, in the Z-axis direction, an electric field, that is, a circularly polarized [in this case, Right-Hand Circularly Polarized (RHCP)] field, is generated by means of combining the above-mentioned Ey field and Ex field. By means of adjusting the shape of the parasitic antennas 2*a* and 2*b* [the shape of the connection portion 12 with the radiating antenna 1 (the length of the parallel part) ], the distance in the Z-axis direction between the radiating antenna 1 and the parasitic antennas 2*a* and 2*b* (the thickness of the substrate 10), the position in the Y-axis direction, it is possible to adjust the intensity and the phase of the orthogonal crossing electric field component, thereby obtaining a circularly polarized wave close to an ideal one.

Figure 7:
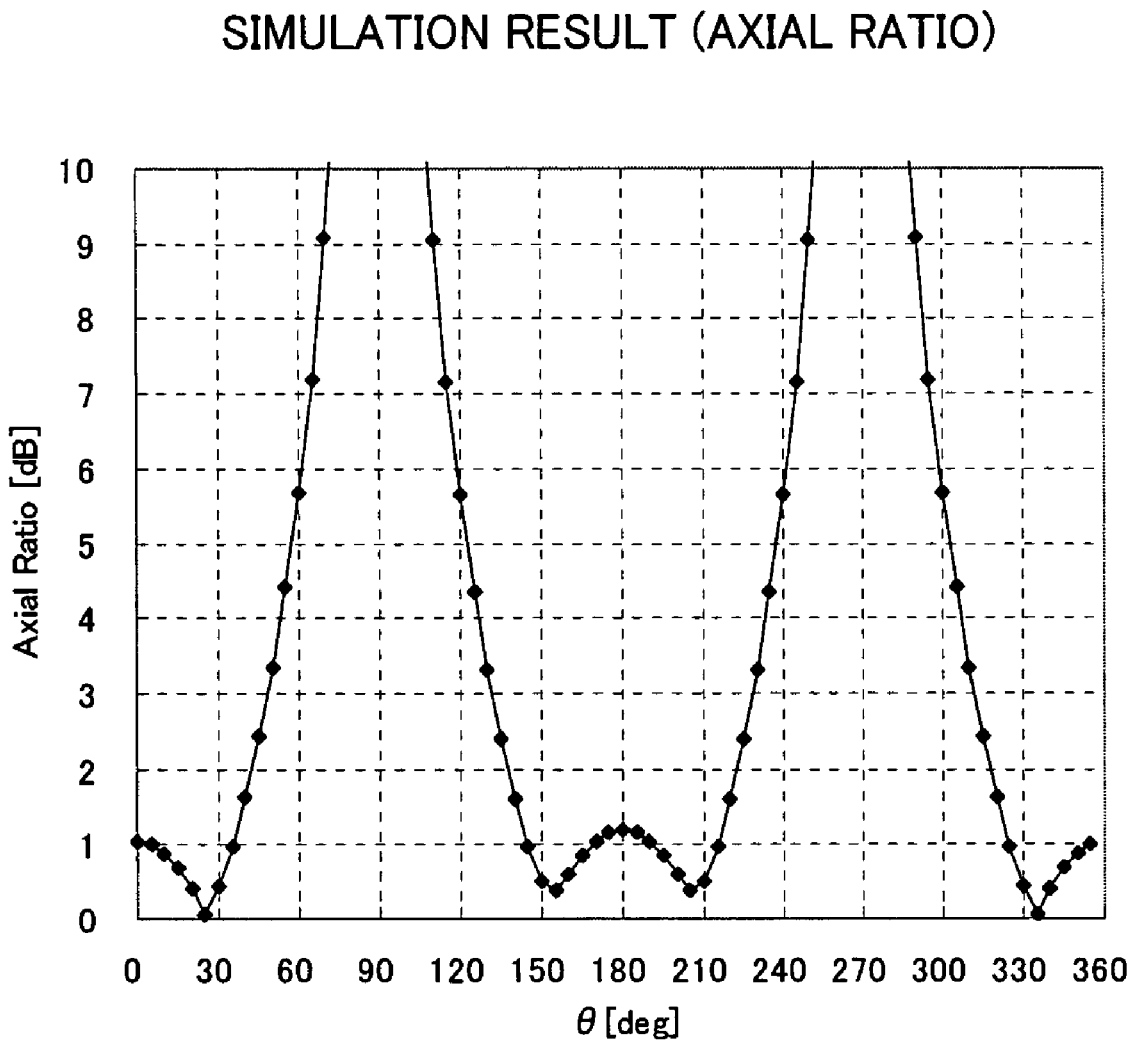
FIG. 7 is a simulation result (axial ratio) of the planar antenna on the assumption of the sizes shown in FIG. 5.
Figure 8:
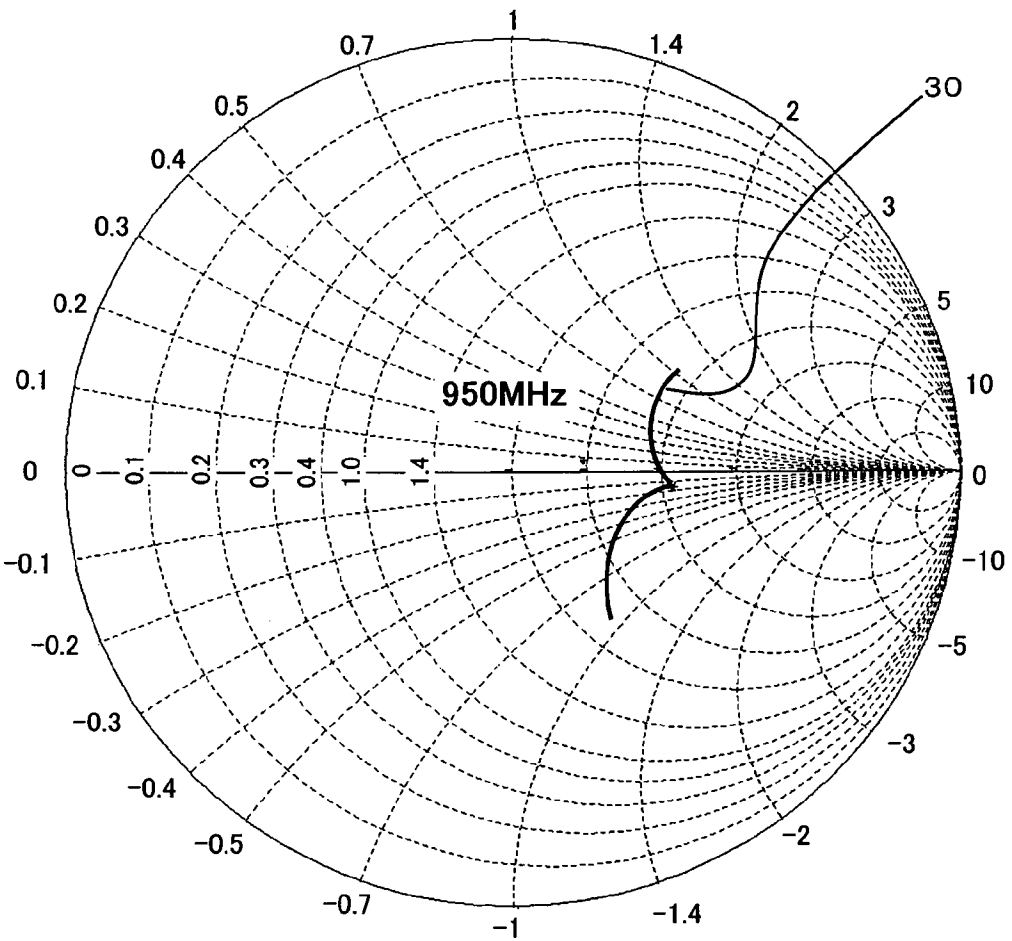
FIG. 8 is a impedance Smith chart of the planar antenna on the assumption of the sizes shown in FIG. 5
Figure 9:
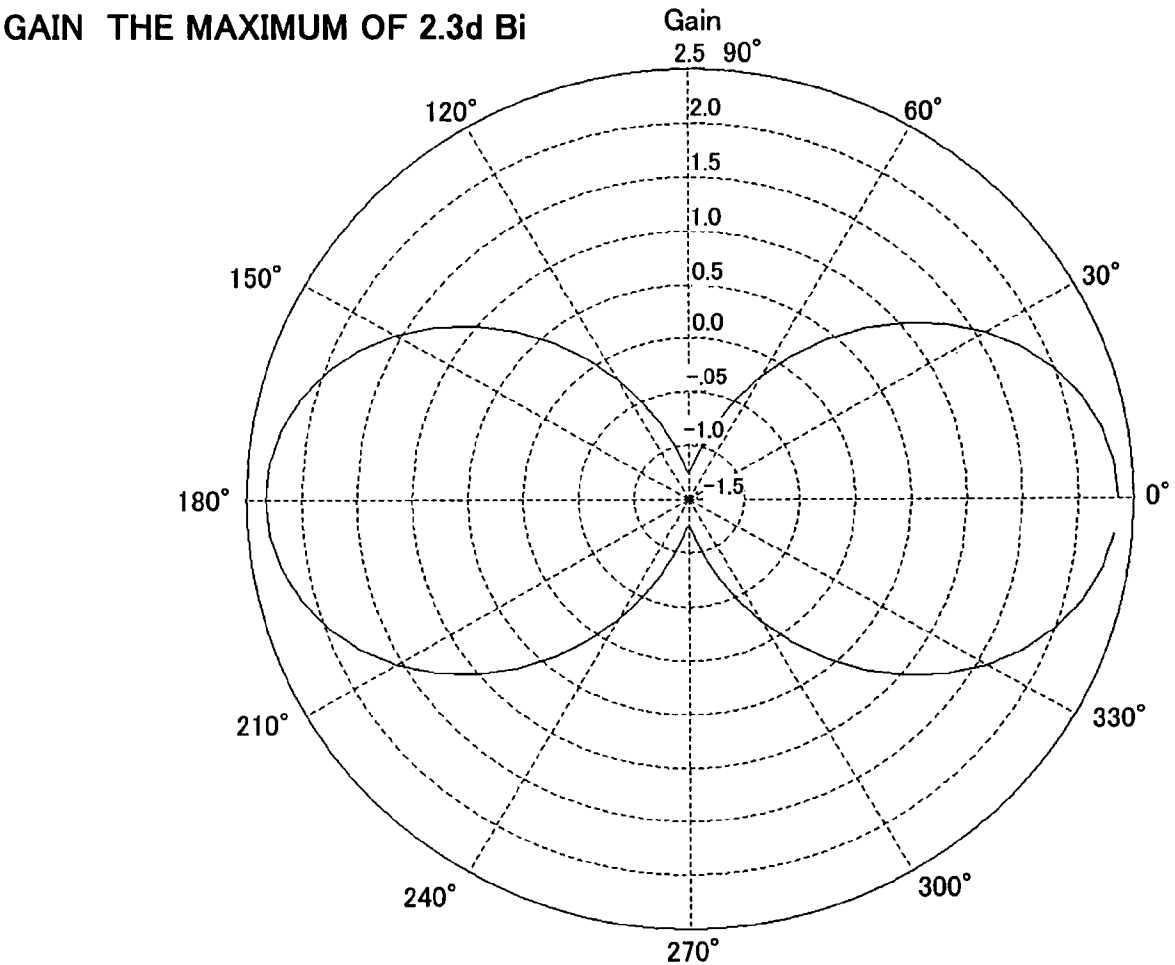
FIG. 9 is a diagram illustrating gain characteristics of the planar antenna on the assumption of the sizes shown in FIG. 5.
Figure 10:
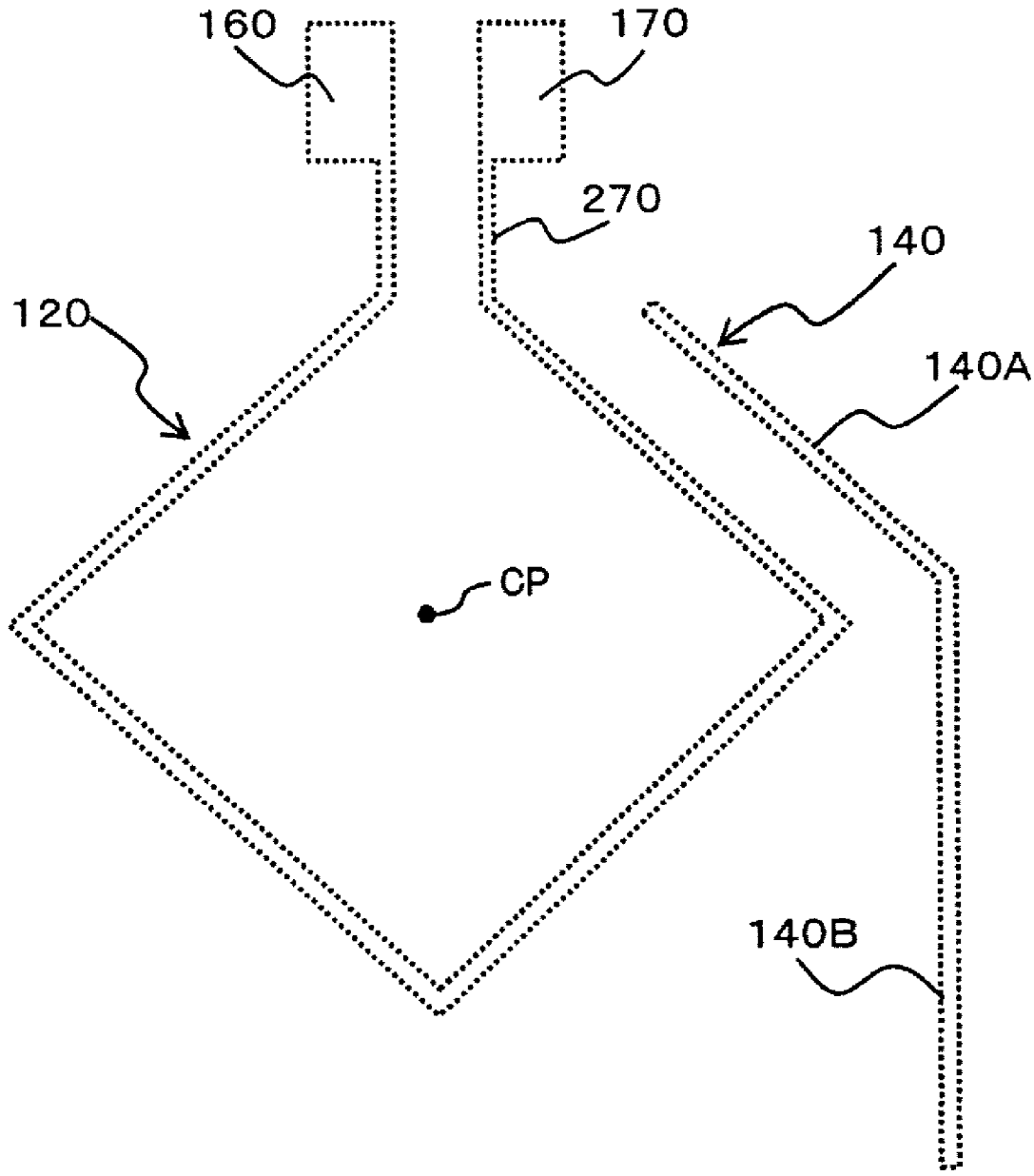
FIG. 10 RELATED ART
FIG. 10 is a schematic plane view illustrating an example of a previous planar antenna.

FIG. 7 shows a simulation result [an Axial Ratio (AR)] in a case where a radio signal of 950 MHz is supplied to the radiating antenna 1, on the assumption that the size described in FIG. 5 and FIG. 6 is given and that each of the antennas 1, 2*a*, and 2*b* are complete electric conductor, and that the substrate 10 does not exist [that is, the space between the XY plane on which is formed the radiating antenna 1 and the XY plane on which the parasitic antennas 2*a*, 2*b* are formed is filled with air (an dielectric constant $\in_r=1$). FIG. 8 shows an impedance Smith chart of the planar antenna under the above simulation condition. FIG. 9 shows gain characteristics of the planar antenna under the above simulation condition.

FIG. 7 and FIG. 9 show the following. Provided the angle between the electric wave (beam) and the +Z-axis is θ, the axial ratio is sharply decreased in the vicinity of the condition that θ=0 (360), 180 [deg], and a good polarized wave in the front-back side direction (±Z-axis direction) of the planar antenna. FIG. 8 shows an impedance characteristic having a typical shape of a circularly polarized wave (the shape of a part of a heart: see reference character 30).

In this manner, according to the planar antenna of the present modified example, a part of the parasitic antennas 2*a* and 2*b* has a meanda line shape, except the connection portion 12. Hence, it is possible to realize a planar antenna which can generate good circularly polarized waves on its front and rear sides, with a smaller size than that of the above-described embodiment.

Although a part of the parasitic antennas 2*a* and 2*b* has the shape of a meanda line in the present example, it can also take the shape of a sawtooth or a wave.

As described above, according to the present invention, it is possible to realize a simple and down-sized planar antenna which can generate a good circularly polarized wave with a construction made of a combination of a linear radiating antenna and more than one parasitic antenna. Hence, the present invention is significantly useful in radio communication technology such as RFID systems, POS systems, and security systems for protecting products from theft.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A planar antenna, comprising:

a linear radiating antenna element to which electric power is to be fed; and a plurality of linear parasitic antenna elements to which electric power is not to be fed, wherein said parasitic antenna elements are disposed at a position at which said linear radiating antenna element and said parasitic antenna elements cross each other without direct contact, said parasitic antenna elements lying in a direction in which said linear radiating antenna elements and said parasitic antenna elements cross each other, wherein each of the crossing portions of said plural parasitic antenna elements, which portions cross said linear radiating antenna element, are bent in such a manner that the crossing portions of said parasitic antenna elements are in parallel with said linear radiating antenna element, wherein said linear radiating antenna element is formed on one side of a dielectric substrate, and wherein said plural parasitic antenna elements are formed on the other side of the dielectric substrate.

2. A planar antenna as set forth in claim 1, wherein each of said plural parasitic antenna elements are disposed so as to be orthogonal to said linear radiating antenna element.

3. A planar antenna as set forth in claim 2, wherein two of the plurality of parasitic antenna elements are disposed at symmetrical positions with respect to a feeding point of said linear radiating antenna element.

4. A planner planar antenna as set forth in claim 3, wherein said linear radiating antenna element and said plural parasitic antenna elements are dipole antenna elements.

5. A planner planar antenna as set forth in claim 2, wherein said linear radiating antenna element and said plural parasitic antenna elements are dipole antenna elements.

6. A planar antenna as set forth in claim 1, wherein two of the plurality of parasitic antenna elements are disposed at symmetrical positions with respect to a feeding point of said linear radiating antenna element.

7. A planar antenna as set forth in claim 6, wherein said linear radiating antenna element and said plural parasitic antenna elements are dipole antenna elements.

8. A planar antenna as set forth in claim 1, wherein said linear radiating antenna element and said plural parasitic antenna elements are dipole antenna elements.

9. A planar antenna as set forth in claim 1, wherein the lengths of said linear radiating antenna element and of said plural parasitic antenna elements arc equal to or approximate to half-wave lengths to be transceived by said linear radiating antenna element and said plural parasitic antenna elements, respectively.

10. A planar antenna as set forth in claim 1, wherein at least a portion of said parasitic antenna elements, excluding the crossing portion, is formed as a meander line.

* * * * *